US008132553B2

(12) United States Patent
Eakins, Jr.

(10) Patent No.: US 8,132,553 B2
(45) Date of Patent: Mar. 13, 2012

(54) RECOIL STARTER SYSTEM

(75) Inventor: Charles Arthur Eakins, Jr., Liberty, SC (US)

(73) Assignee: Techtronic Outdoor Products Technology Limited, Hamilton (BM)

( * ) Notice: Subject to any disclaimer, the term of this patent is extended or adjusted under 35 U.S.C. 154(b) by 278 days.

(21) Appl. No.: 12/398,582

(22) Filed: Mar. 5, 2009

(65) Prior Publication Data

US 2010/0132650 A1 Jun. 3, 2010

Related U.S. Application Data

(60) Provisional application No. 61/119,627, filed on Dec. 3, 2008.

(51) Int. Cl.
*F02N 1/00* (2006.01)

(52) U.S. Cl. ..... 123/185.3; 123/185.2; 123/185.14

(58) Field of Classification Search ..... 123/185.3, 123/185.2, 185.14, 185.7
See application file for complete search history.

(56) References Cited

U.S. PATENT DOCUMENTS

| | | | | |
|---|---|---|---|---|
| 2,804,173 | A | 8/1957 | De Millar | |
| 2,869,682 | A | 1/1959 | De Millar | |
| 2,999,489 | A | 9/1961 | Coughlin et al. | |
| 3,084,679 | A | 4/1963 | Brown et al. | |
| 3,140,703 | A | 7/1964 | Barr | |
| 3,165,100 | A | 1/1965 | Svendsen | |
| 3,306,277 | A | 2/1967 | Gudmundsen | |
| 3,332,410 | A * | 7/1967 | Dwyer, Jr. | 123/185.3 |
| 3,858,566 | A * | 1/1975 | Perry | 123/185.2 |
| 5,287,832 | A | 2/1994 | Uhl | |
| 5,431,135 | A * | 7/1995 | Tyler | 123/185.3 |
| 5,537,966 | A | 7/1996 | Ohnishi | |
| 5,826,555 | A * | 10/1998 | Aronsson et al. | 123/185.3 |
| 6,755,170 | B2 | 6/2004 | Morishige et al. | |
| 6,782,863 | B2 | 8/2004 | Leasure et al. | |
| 6,834,633 | B2 | 12/2004 | Sing et al. | |
| 7,069,896 | B2 | 7/2006 | Tsunoda et al. | |
| 7,140,341 | B2 | 11/2006 | Dahlberg | |
| 7,191,752 | B2 | 3/2007 | Schriever et al. | |
| 7,201,130 | B2 | 4/2007 | Hashiba | |
| 7,213,561 | B2 | 5/2007 | Hashiba | |
| 7,252,065 | B1 | 8/2007 | Keeton | |
| 2003/0094154 | A1 * | 5/2003 | Morishige et al. | 123/185.3 |
| 2006/0219204 | A1 * | 10/2006 | Hashiba | 123/185.3 |
| 2007/0131190 | A1 * | 6/2007 | Hashiba | 123/185.3 |
| 2010/0162985 | A1 * | 7/2010 | Hashiba et al. | 123/185.3 |
| 2010/0170465 | A1 * | 7/2010 | Eakins, Jr. | 123/185.3 |

* cited by examiner

*Primary Examiner* — Willis Wolfe, Jr.
*Assistant Examiner* — Anthony L Bacon
(74) *Attorney, Agent, or Firm* — Michael Best & Friedrich LLP

(57) ABSTRACT

A recoil starter system and method. The system may include a drive member, a pulley member, and a spring member. The drive member may include a first retainer, and the pulley member may include a second retainer, the retainers being engageable to connect the drive member and the pulley member and to inhibit relative axial movement between the pulley member and the drive member. The spring member may be configured to absorb and limit the variations in the pulling torque produced by the engine resulting in a smooth and constant pull force.

15 Claims, 16 Drawing Sheets

RECOIL STARTER SYSTEM

CROSS-REFERENCE TO RELATED APPLICATION

This application claims priority to U.S. Provisional Patent Application Ser. No. 61/119,627, filed Dec. 3, 2008, the entire contends of which is incorporated by reference.

FIELD OF THE INVENTION

The present invention relates to a recoil starter for an engine such as an internal combustion engine.

SUMMARY

A recoil starter is typically used in small internal combustion engines, such as a two stroke engine or a single cylinder configuration. Recoil starters generally include a pull cord wrapped about a pulley, the pulley being rotated by pulling on the pull cord. The rotational energy generated from the pull cord and pulley is transferred to the drive shaft of the engine through a ratchet and/or clutch mechanism. The rotation transferred to the drive shaft begins the engine cycle and starts the engine.

In operating such a starter, abrupt changes in the engine torque due to, for example, the compression of an air/fuel mixture by the piston and the cylinder in the engine may result in an uneven and jarring pulling force during starting and possibly even some kickback forces. These forces can make starting the engine difficult for a user, creating stresses that can even cause discomfort to the user.

Additionally, conventional starters have rotational limits due to the orientation of the internal springs and layout of the components. Some starters may also be prone to buckling and melting or welding due to misalignment during rotation of the two components with respect to one another. The structural shortcomings can lead to premature failure of the unit and/or "buckling" of the internal springs.

In some independent aspects and in some constructions, a recoil starter system may include a drive member engageable with an engine and including a first retainer, a pulley member supportable for rotation about an axis, the pulley member including a second retainer engageable with the first retainer to connect the pulley member to the drive member and to inhibit relative axial movement between the pulley member and the drive member, and a spring member coupled between the drive member and the pulley member.

In some constructions, one retainer includes a radially-extending annular lip, and the other retainer is engageable with the annular lip. The other retainer may include a plurality of retention members, each of the plurality of retention members being spaced apart about the axis and engageable with the annular lip. At least one retainer may be flexible to enable engagement of the retainers.

In some constructions, the spring member is connected to the drive member and to the pulley member and inhibits relative axial movement of the drive member and the pulley member. The spring member may include portions which engage the outer surfaces drive member and the pulley member to inhibit relative axial movement of the drive member and the pulley member.

In some independent aspects and in some constructions, a recoil starter system may include a drive member engageable with an engine, a pulley member supportable for rotation about an axis, and a spring member connected between the drive member and the pulley member to inhibit relative axial movement between the drive member and the pulley member.

In some constructions, when connected, the drive member and the pulley member may cooperate to define a cavity, and at least a substantial portion of the spring member is supported in the cavity. The drive member and the pulley member may each define an opening and a slot communicating with the opening, and an opposite end of the spring extends through each opening and is received in the associated slot. In some constructions, at least the pulley member further may include a spring support ramp engaging the spring for at least a portion of the spring circumference to inhibit unwanted motion of the spring member.

In some independent aspects and in some constructions, a method of assembling a recoil starter system, the method may include engaging retainers to connect the pulley member to the drive member and to inhibit relative axial movement between the pulley member and the drive member, and coupling a spring member between the drive member and the pulley member.

In some constructions, engaging may include flexing at least one of the first retainer and the second retainer from a retention position, positioning at least the other of the first retainer and the second retainer for engagement, and returning the at least one of the first retainer and the second retainer to the retention position such that the first retainer and the second retainer are engaged to connect the pulley member and the drive member.

In some constructions, the recoil starter system may include a connecting arrangement to connect the system as a unit, and the connecting arrangement may be provided by the drive member and the pulley member. Also, in some constructions, when assembled, the drive member and the pulley member may be rotatable beyond 90 degrees with respect to one another.

In some constructions, the spring member may be configured to transmit force generated by the pulley member and to absorb and limit variations in the pulling torque produced by the engine, resulting in a smooth and constant pull force. Also, in some constructions, the spring member may provide at least a portion of the connecting arrangement.

Independent features and independent advantages of the present invention will become apparent to those skilled in the art upon review of the following detailed description, claims and drawings.

Figure 1:
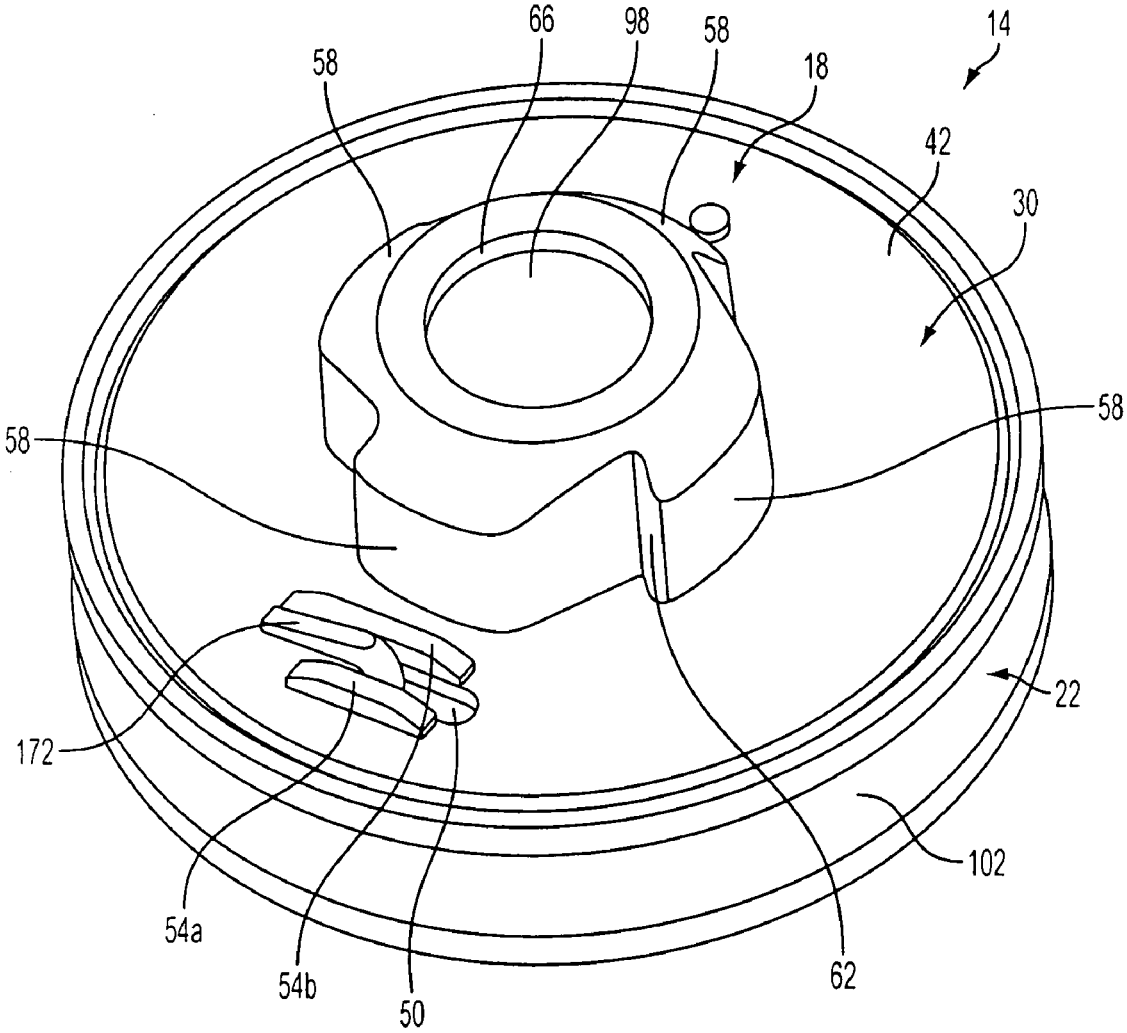
FIG. 1 is a top perspective view of a recoil starter system.

Before any independent features and at least one construction of the invention are explained in detail, it is to be understood that the invention is not limited in its application to the details of construction and the arrangements of the components set forth in the following description or illustrated in the drawings. The invention is capable of other constructions and of being practiced or being carried out in various ways. Also, it is understood that the phraseology and terminology used herein is for the purpose of description and should not be regarded as limiting. The use of "including", "having" and "comprising" and variations thereof herein is meant to encompass the items listed thereafter and equivalents thereof as well as additional items.

Although references may be made below to directions, such as upper, lower, downward, upward, rearward, bottom, front, rear, etc., in describing the drawings, these references are made relative to the drawings (as normally viewed) for convenience. These directions are not intended to be taken literally or limit the present invention in any form. In addition, terms such as "first" and "second" are used herein for purposes of description and are not intended to indicate or imply relative importance or significance.

DETAILED DESCRIPTION

FIGS. 1-6 illustrate a recoil starter system 14 for use with an internal combustion engine (not shown). As described below in more detail, the recoil starter system 14 generally includes a drive member 18 engageable with the engine, a pulley member 22 supportable for rotation about an axis A, and a spring member 26 coupled between the drive member 18 and the pulley member 22. The pulley member 22 is manually rotatable by means of, for example, in the illustrated construction, a pull rope (not shown) actuated by the operator. The force generated by the pulley member 22 is transmitted through the spring member 26 to the drive member 18, and the spring member 26 is able to absorb any fluctuations in the pulling requirements. The drive member 18 transmits the rotational force to the engine to start the engine.

U.S. Pat. Nos. 7,191,752 and 7,201,130 describe and illustrate recoil starters for use with an engine. With respect to the use and assembly of the recoil starter system 14 with an engine, the contents of these patents are hereby incorporated by reference.

As shown in more detail in FIGS. 5-9, the drive member 18 generally includes a main portion or plate 30, a ratchet portion 34 extending axially on one side of the plate 30 and configured to engage the engine (e.g., the flywheel of the engine via a clutch or ratchet mechanism (not shown)), and a support portion 38 extending axially on the other side of the plate 30.

The plate 30 has a first surface 42 and a second surface 46 and defines a recess 50 shaped to receive a portion of the spring member 26 (as described below). A slot 54 is defined adjacent the recess 50 by ridges 54*a*, 54*b* extending from the first surface 42 of the plate 30. The slot 54 communicates with the recess 50 and is shaped to receive and retain a portion of the spring member 26 (as described below).

In the illustrated construction, the ridges 54*a* and 54*b* are shown as two separate portions extending generally tangentially. In alternate constructions, the slot 54 may be configured with U-shape or as a covered slot 54 and/or may extend in another direction (e.g., radially). Also, in other constructions, the slot 54 may be defined at least partially into the first surface 42 of the plate 30. In such constructions, the ridges 54*a* and 54*b* may cooperate with the portion of the slot 54 formed in the first surface 42 or may not be provided.

The ratchet portion 34 extends substantially axially from the first surface 42 of the plate 30 and is engageable with a portion of the engine (e.g., a clutch or ratchet mechanism connected to a drive shaft). The ratchet portion 34 is generally cylindrical and includes a plurality ratchet teeth 58 (four ratchet teeth 58 in the illustrated construction). Each ratchet tooth 58 extends radially from the ratchet portion 34 and provides a contact surface 62.

Each ratchet tooth 58 is shaped to engage one of a plurality of pawls (not shown) of the clutch mechanism when rotated in a clockwise starting direction (in FIG. 8) and to spin freely with respect to the plurality of pawls when rotated in a counterclockwise recoil direction. The ratchet portion 34 is disconnected from the clutch mechanism during engine operation. The ratchet portion 34 and ratchet teeth 58 are formed of sufficient size, shape and number to provide, for example, adequate strength, engagement area, etc. to transmit input torque to the clutch mechanism without deformation or failure.

The ratchet portion 34 and the support portion 38 cooperate to define a central portion 66 of the drive member 18. The central portion 66 has a top wall 70 and a substantially cylindrical side wall 74. The top wall 70 supports the drive member 18 with respect to the pulley member 22 and defines an opening 78. The side wall 74 is sized to receive the pulley member 22 and to permit relative rotational movement between the drive member 18 and the pulley member 22. In alternate constructions, the inner diameter of the side wall 74 may be increased to allow clearance for bearings or other devices to facilitate relative rotation between the drive member 18 and the pulley member 22.

The support portion 38 extends axially from the second surface 46 of the plate 30, and a first retainer 80 extends radially from the support portion 38. In the illustrated construction, the first retainer 80 is configured as a continuous annular radial ridge. The first retainer 80 has an angled lead-in surface 82 and a retaining surface 86.

In alternate constructions (not shown), the first retainer 80 may include another configuration to provide a connection between the drive member 18 and the pulley member 22. For example, the first retainer 80 may be formed as one or more ridges extending about only a portion of the circumference of the support portion 38. The first retainer 80 may include a number of relatively narrow retaining tabs.

Figure 6:
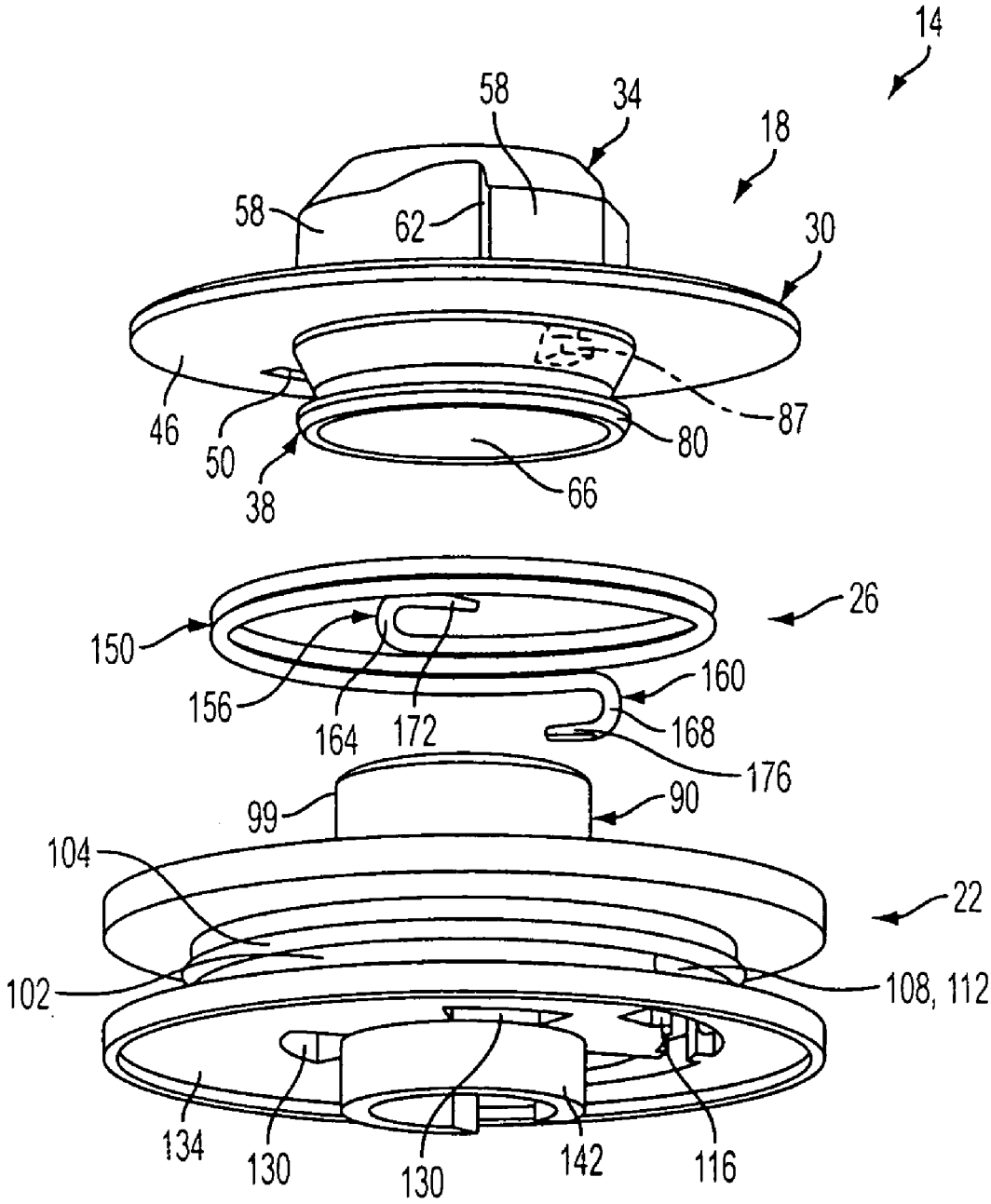
FIG. 6 is an exploded bottom view of the recoil starter system shown FIG. 1.
Figure 7:
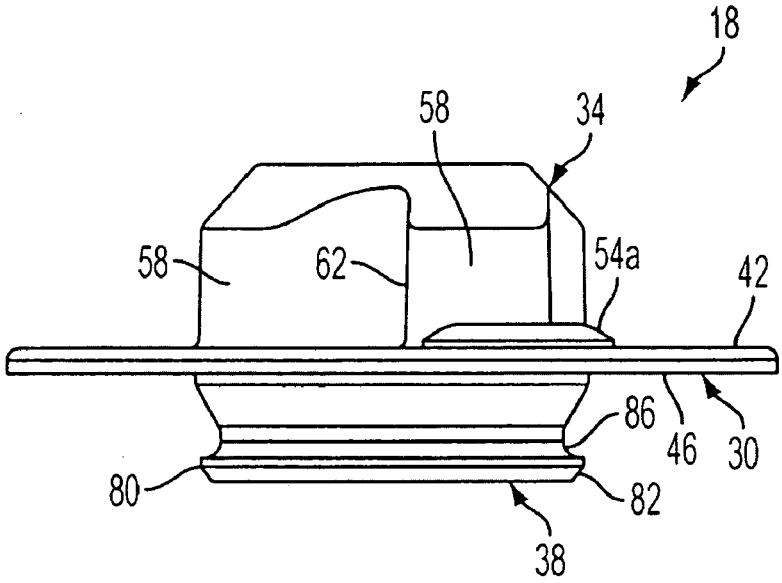
FIG. 7 is a side view of the drive member of the recoil starter system.
Figure 8:
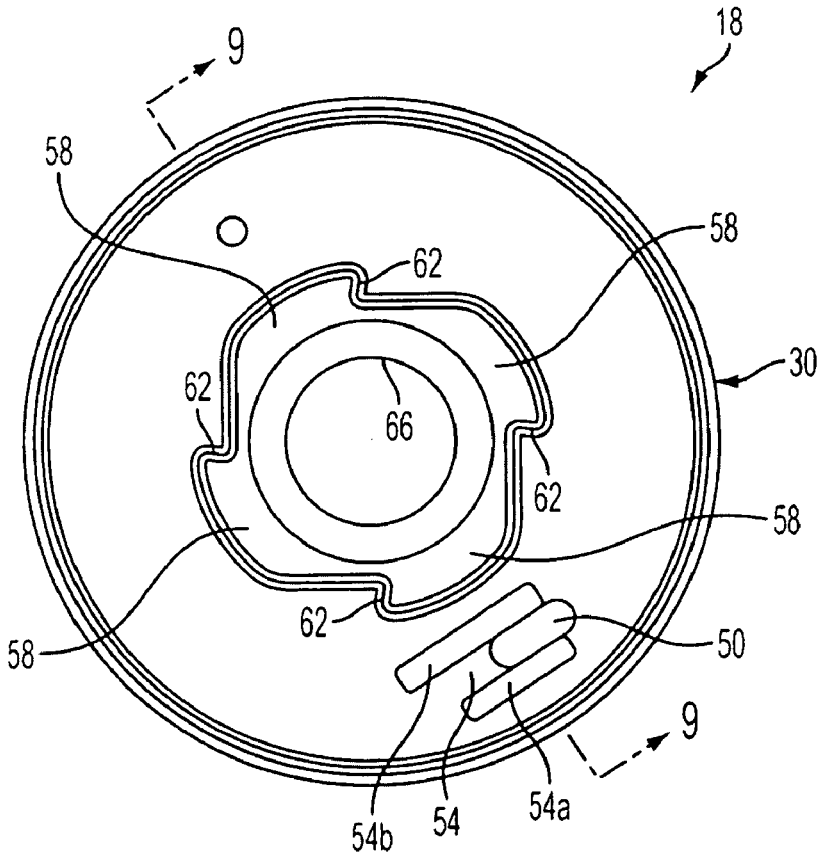
FIG. 8 is a top view of the drive member shown in FIG. 7.
Figure 9:
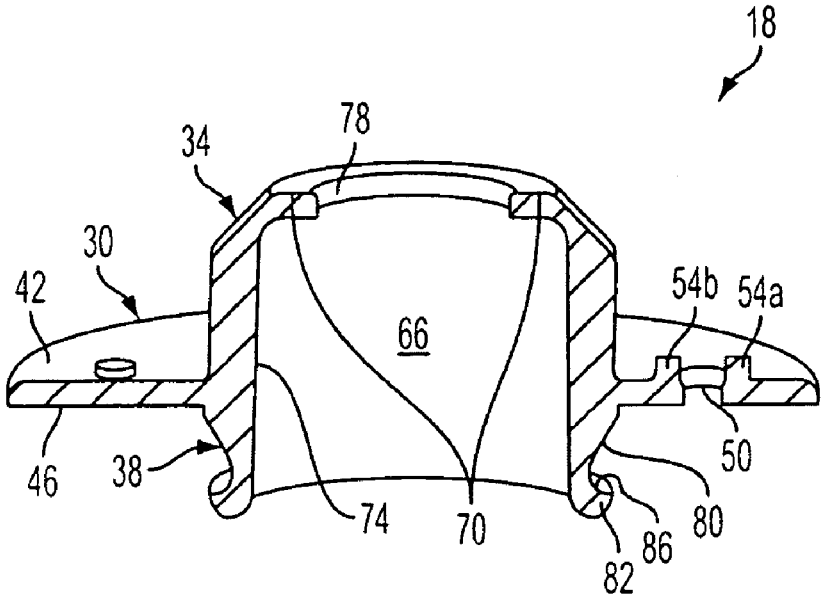
FIG. 9 is a cross-section view of the drive member taken generally along line 9-9 in FIG. 8.

As shown in FIG. 6, a rotation-limiting tab 87 may extend radially from the support portion 38 to limit the relative pivoting movement between the drive member 18 and the pulley member 22. However, the tab 87 is generally not provided such that full 360 degree rotation of the drive member 18 relative to the pulley member 22 is allowed.

In the illustrated construction, the drive member 18 is formed (e.g., by molding) as a single unitary piece of a tough, rigid material (e.g. glass filled nylon). In other constructions, the drive member 18 may be formed as two or more separate elements which are connected or fixed to provide the drive member 18.

As shown in more detail in FIGS. 5-6 and 10-14, the pulley member 22 includes a central hub 90 and a main body 94 extending radially from the central hub 90. The central hub 90 is substantially cylindrical and defines a central opening 98. The central opening 98 receives a shaft, such as a support shaft, bearing, hub, on which the pulley member 22 and the recoil starter system 14 is rotatably supported. The central hub 90 fits within the side wall 74 of the drive plate 18 with sufficient clearance to allow relative rotation between the drive plate 18 and the pulley member 22. When the drive member 18 and the pulley member 22 are connected, the end of the central hub 90 may contact, or nearly contact the top wall 70 of the drive member 18, and the opening 78 is concentric with the central opening 98. The opening 78 may also accommodate a portion of a shaft received in the central opening 98.

The main body 94 extends generally radially from the central hub 90. The main body 94 defines an outwardly-facing radial groove 102 for receiving a pull cord (not shown). The radial groove 102 is substantially "U" shaped and runs substantially the entire circumference of the main body 94. In the illustrated construction, the radial groove 102 has sufficient width and depth to support multiple windings of the pull cord. A helical ridge 104 is formed in the groove 102 to aid in proper coiling of the pull cord.

To secure the free end of the pull cord to the pulley member 22, a cord retention recess 108 (see FIG. 14) is defined by the main body 94. In the illustrated construction, the cord retention recess 108 includes a first end 112 in communication with the radial groove 102 and a second end 116 shaped to capture the free end of the pull cord and prevent its removal. In the illustrated construction, the second end 116 is a narrow groove shaped to retain a widened portion (e.g., a knot) of the pull cord. In alternate constructions, the second end 116 may include another structure to secure the free end of the pull cord, such as, for example, fasteners, coupling teeth, wedges, adhesive, welding, etc.

The main body 94 cooperates with the drive member 18 to define a cavity 120, and, in the illustrated construction (see FIGS. 10, 12 and 14), a second retainer 124 is located on the main body 94 to be within the cavity 120. The retainers 80 and 124 provide a connecting arrangement to connect the drive member 18 to the pulley member 22 while allowing relative pivoting movement between the drive member 18 and the pulley member 22. In the illustrated construction, the connecting arrangement inhibits relative axial movement of the members 18 and 22 and allows full 360 degree relative rotation of the members 18 and 22.

The second retainer 124 is configured to engage with and capture the first retainer 80. In the illustrated construction, the second retainer 124 includes a plurality of tabs 126 (four tabs 126 in the illustrated construction). In the illustrated construction (see FIGS. 11-14), openings 130 are provided at the base of each tab 126 to, for example, enable manufacture by injection molding. The tabs 126 are circumferentially spaced to, for example, distribute the retaining forces, maintain proper alignment of the members 18 and 22, etc. Equal distribution of forces between and proper alignment of the drive member 18 and the pulley member 22 may limit wear and possible binding during relative pivoting movement.

Each tab 126 is constructed to deflect radially outwardly upon initial engagement with the angled lead-in surface 82 of the first retainer 80, and the surface 82 facilitates engagement of the retainers 80 and 124. Upon further axial movement of the drive member 18 into engagement with the pulley member 22, each tab 126 returns to its retaining position so that the tabs 126 engage the retaining surface 86 of the drive member 18 such that the drive member 18 is axially connected to the pulley member 22. With such a connection, the drive member 18 is pivotable relative to the pulley member 22. In the illustrated construction, the recoil starter system 14 may thus be substantially connected as a unit without separate fastening structure.

In alternate constructions (not shown), the second retainer 124 may include another configuration to provide a connection between the drive member 18 and the pulley member 22. For example, the second retainer 124 may be formed as one or more ridges extending about the circumference of the central hub 90, and, in such a construction, the first retainer 80 may include a number of relatively narrow retaining tabs.

Other connecting arrangements, such as, for example, a bayonet engagement, may be provided between the retainers 80 and 124. In such an arrangement, the retainers 80 and 124 may be engageable in one rotational position (an engagement position) and rotated to another rotational position in which disengagement is prevented. The engagement position would be rotationally beyond the range of operating positions such that the retainers 80 and 124 are not disengaged during operation.

Figure 12:
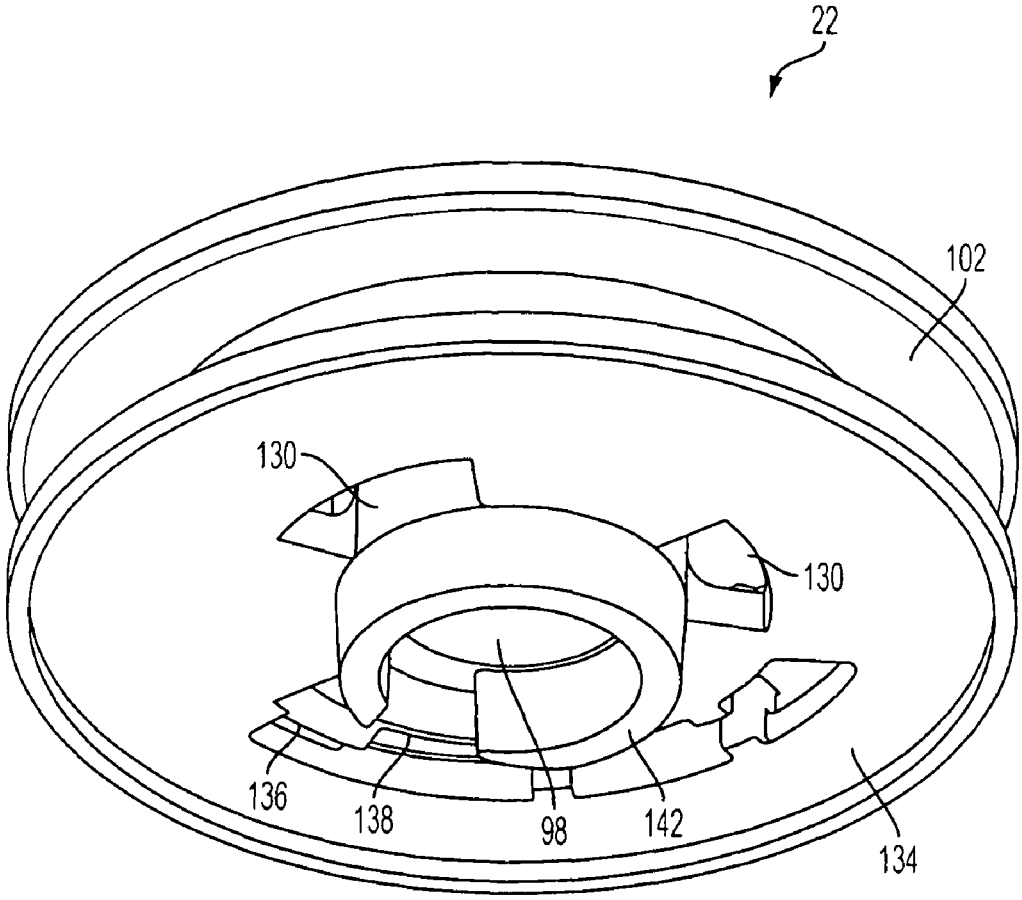
FIG. 12 is a top view of the pulley member shown in FIG. 10.
Figure 13:
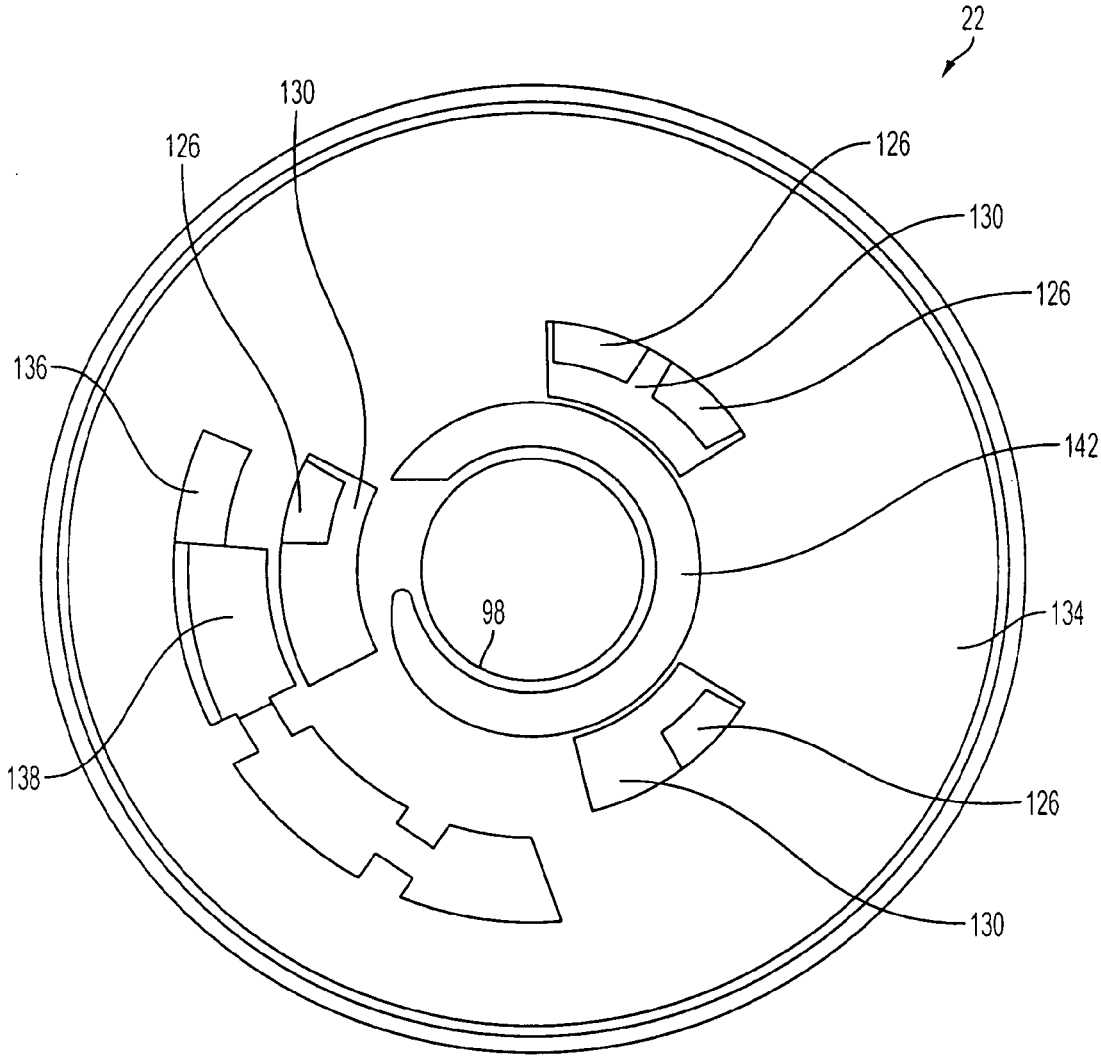
FIG. 13 is a bottom view of the pulley member shown in FIG. 10.

As shown in FIGS. 12 and 13, a second slot 136 is provided on a bottom surface 134 of the main body 94. The slot 136 is configured to receive and retain a portion of the spring member 26 (as described below). In the illustrated construction, the slot 136 is recessed into the bottom surface 134 and extends generally tangentially. The slot 136 is generally adjacent and in communication with a recess 138 which opens into the cavity 120.

In the illustrated construction, the slot 136 is bordered on three sides. In alternative constructions, the slot 136 may be formed by a plurality of ridges (similar to the ridges **54*a* and 54*b* for the first slot 54**) or as a covered slot and/or may extend in another direction (e.g., radially).

Figure 14:
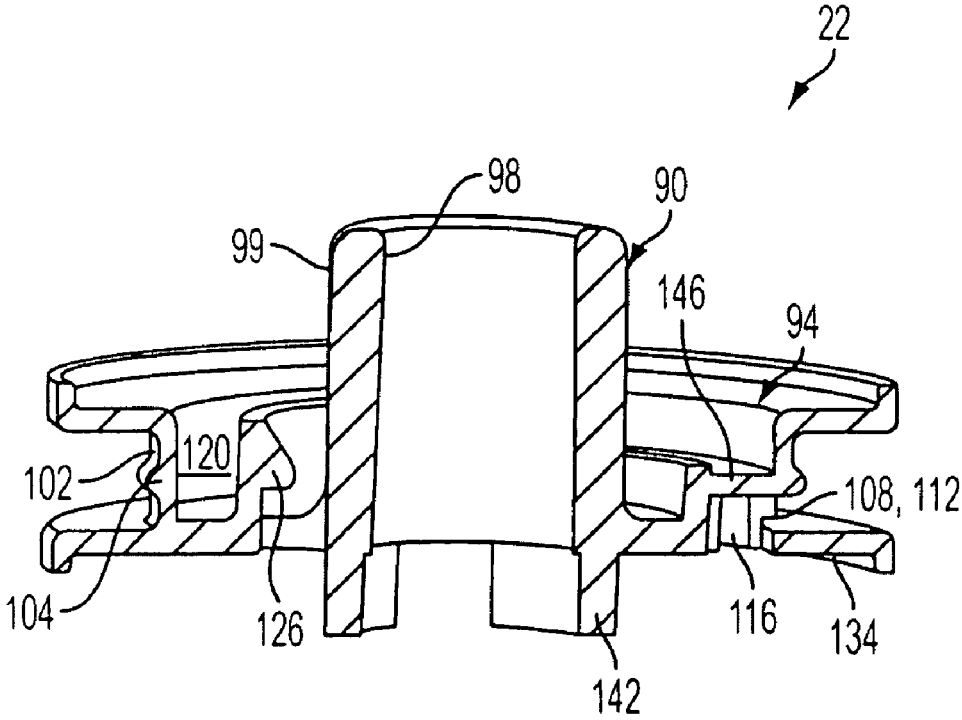
FIG. 14 is a cross-section view of the pulley member taken generally along line 14-14 in FIG. 11.
Figure 10:
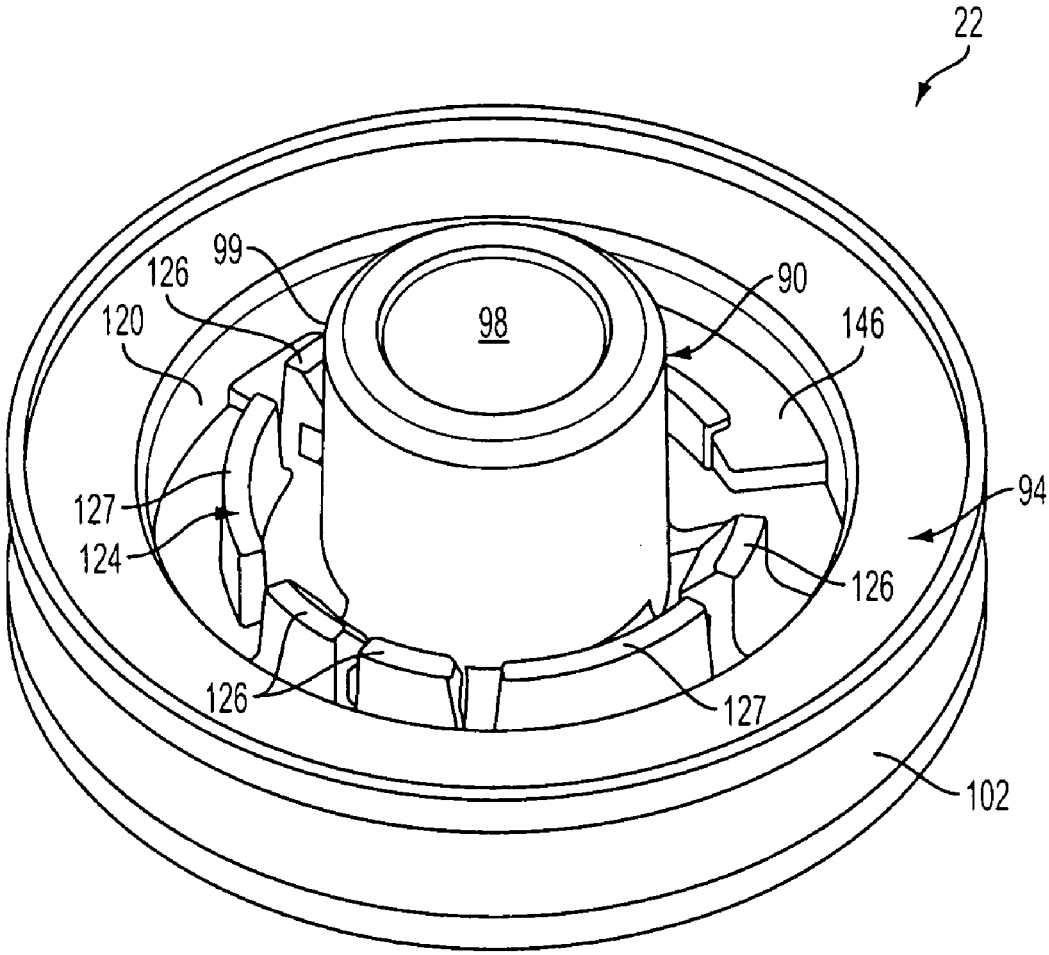
FIG. 10 is a top perspective view of a pulley member of the recoil starter system.
Figure 11:
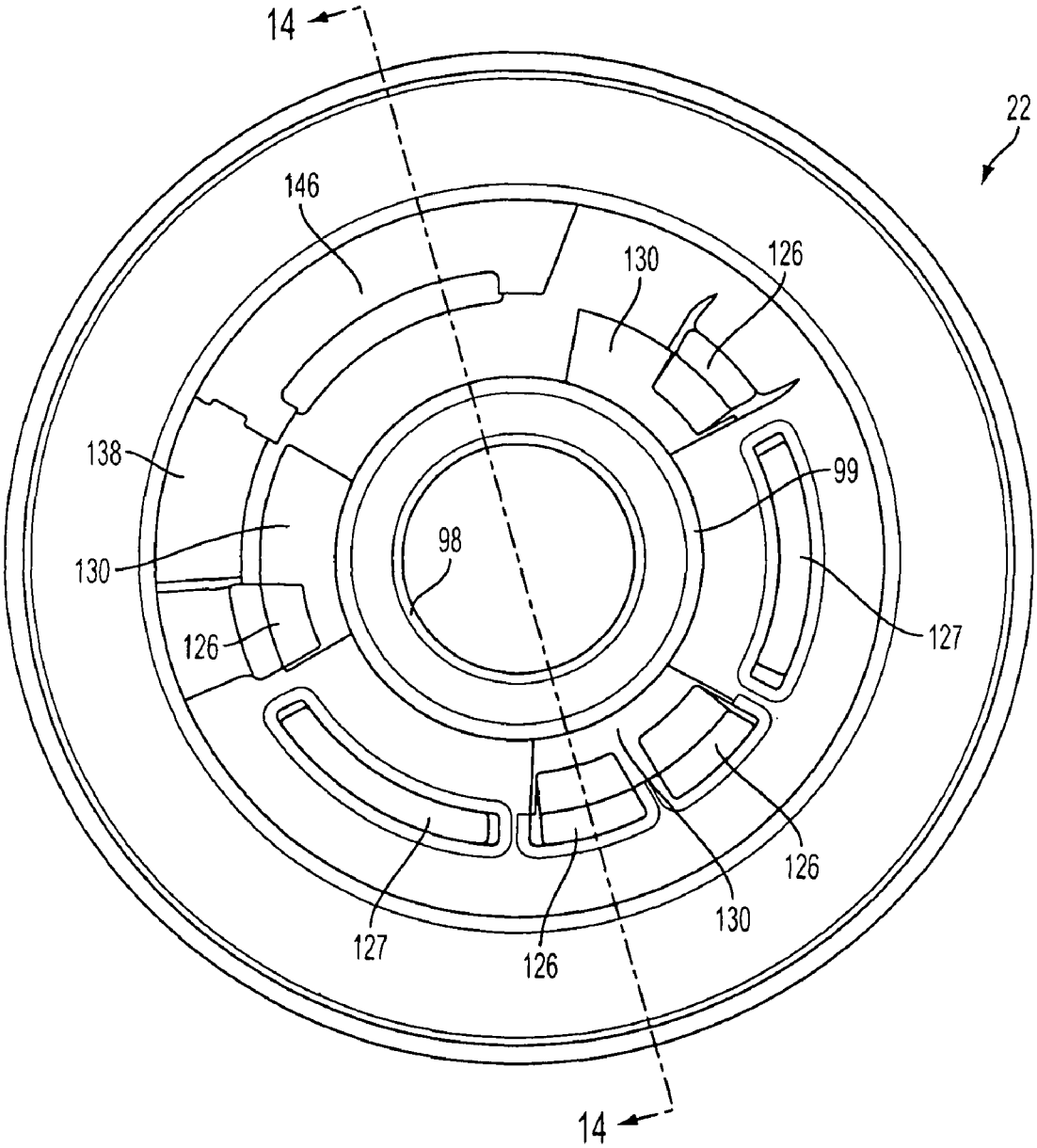
FIG. 11 is a bottom perspective view of the pulley member shown in FIG. 10.

As shown in FIGS. 11 and 13-14, a recoil spring retainer 142 extends axially from the bottom surface 134 of the main body 94. The recoil spring retainer 142 receives one end of a recoil spring (not shown), and the other end of the recoil spring is connected to adjacent fixed structure (e.g., the housing (not shown)). The recoil spring operates to rotate the pulley member 22 and the recoil starter system 14 in the direction opposite to the pulling direction and to wind the pull cord within the radial groove 102.

As shown in FIGS. 10, 12, 14 and 18-19, a spring support 146 is provided in the cavity 120. The spring support 146 extends a portion of the circumference of the pulley member 22 and forms a substantially wedge shape. The wedge begins near the recess 138 and extends gradually into the cavity 120. The spring support 146 provides stability to the spring member 26, preventing the spring member 26 from tilting relative to the axis A, and limits spring distortion when the spring member 26 is acted upon by a force.

In the illustrated construction, the pulley member 22 is formed (e.g., by molding) as a single unitary piece of a tough, rigid material (e.g. glass filled nylon). In other constructions, the pulley member 22 may be formed as two or more separate elements which are connected or fixed to provide the pulley member 22.

In the illustrated construction, the drive member 18 and the pulley member 22 are formed of the same material. In other constructions, the members 18 and 22 may be formed of different materials (e.g., the drive member 18 may be formed of a more durable material).

Figure 5:
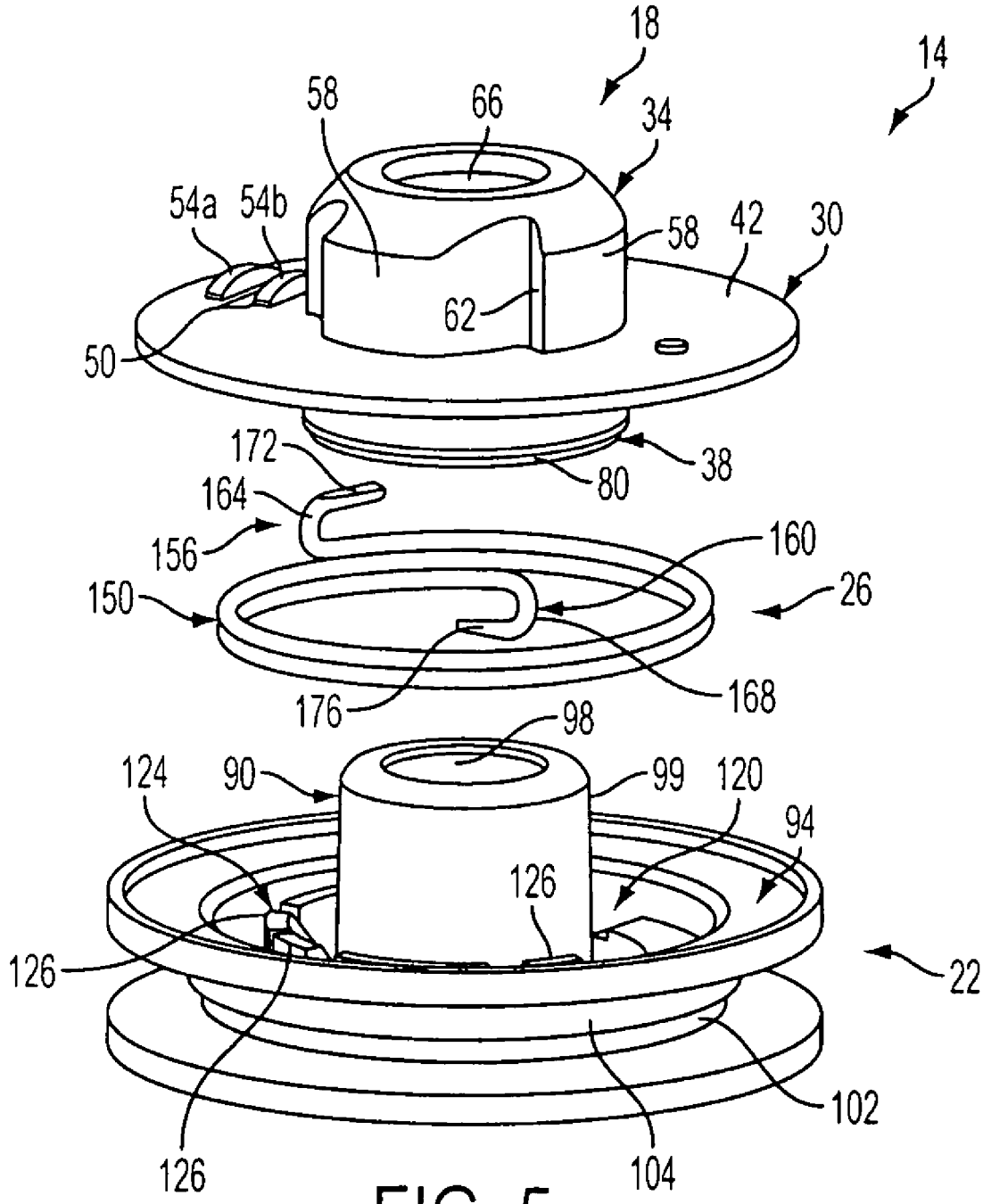
FIG. 5 is an exploded top view of the recoil starter system shown in FIG. 1.
Figure 15:
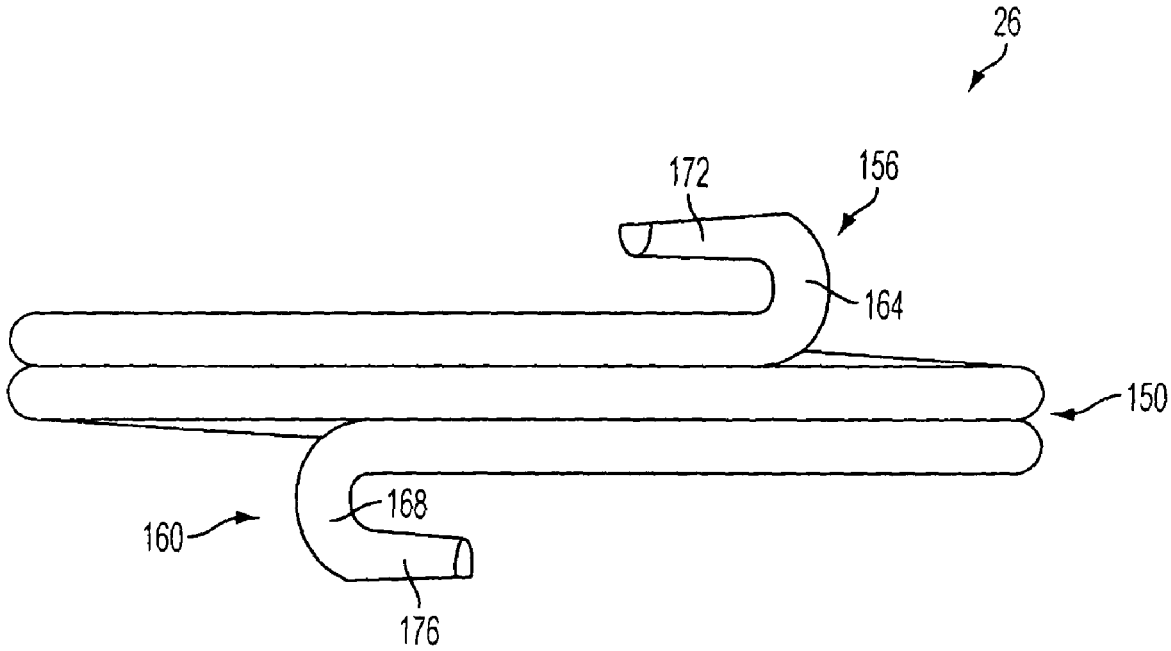
FIG. 15 is a side view of a spring member of the recoil starter system.
Figure 16:
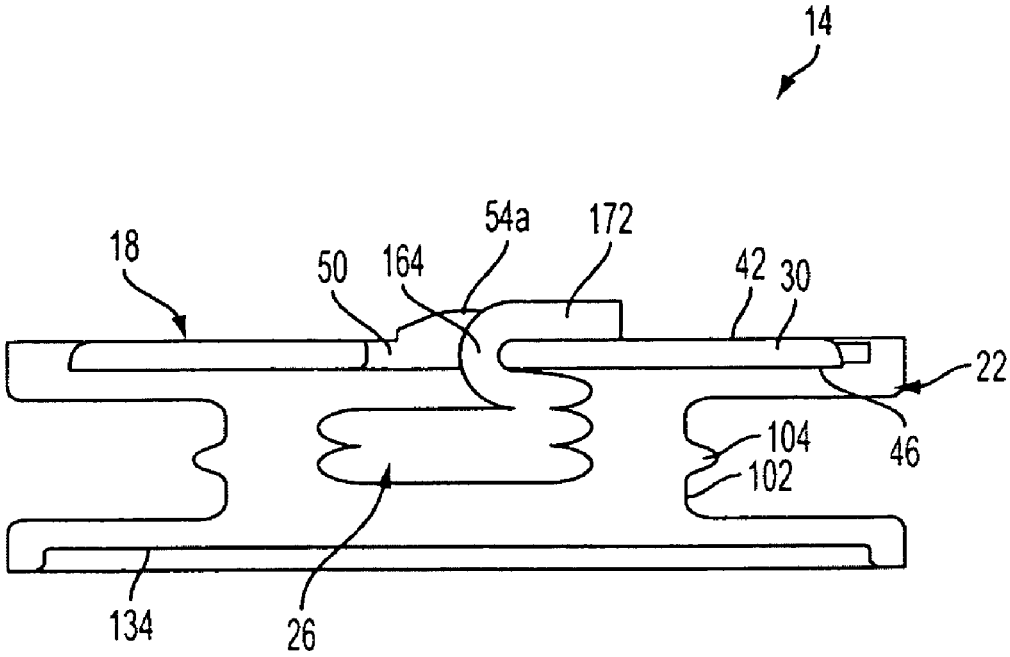
FIG. 16 is a cross-sectional view taken of the recoil starter system generally along line 16-16 in FIG. 3.
Figure 17:
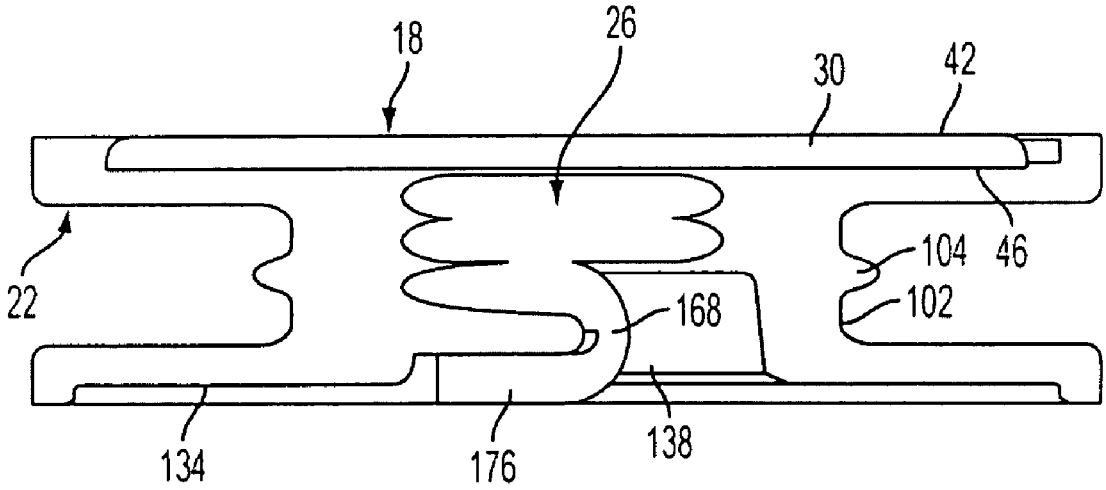
FIG. 17 is a cross-sectional view taken of the recoil starter system generally along line 17-17 in FIG. 4.

As shown more clearly in FIGS. 5-6 and 15, the spring member 26 includes a generally helical body portion 150, a first end 156, and a second end 160. The opposite ends 156, 160 are substantially hook shaped. Each end 156, 160 respectively includes an axially extending leg 164, 168 and an engaging portion 172, 176 which is chamfered.

Figure 2:
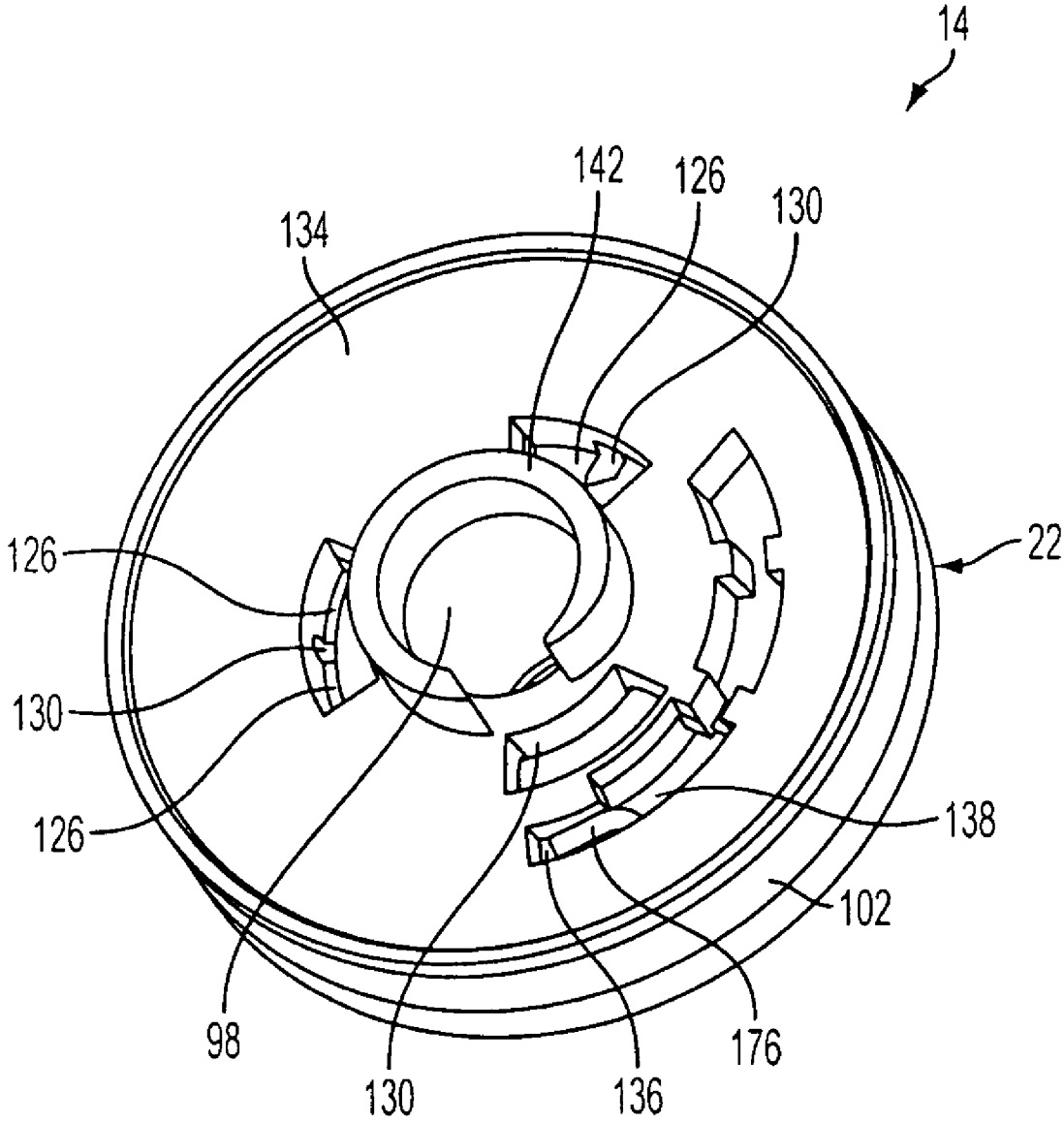
FIG. 2 is a bottom perspective view of the recoil starter system shown in FIG. 1.
Figure 3:
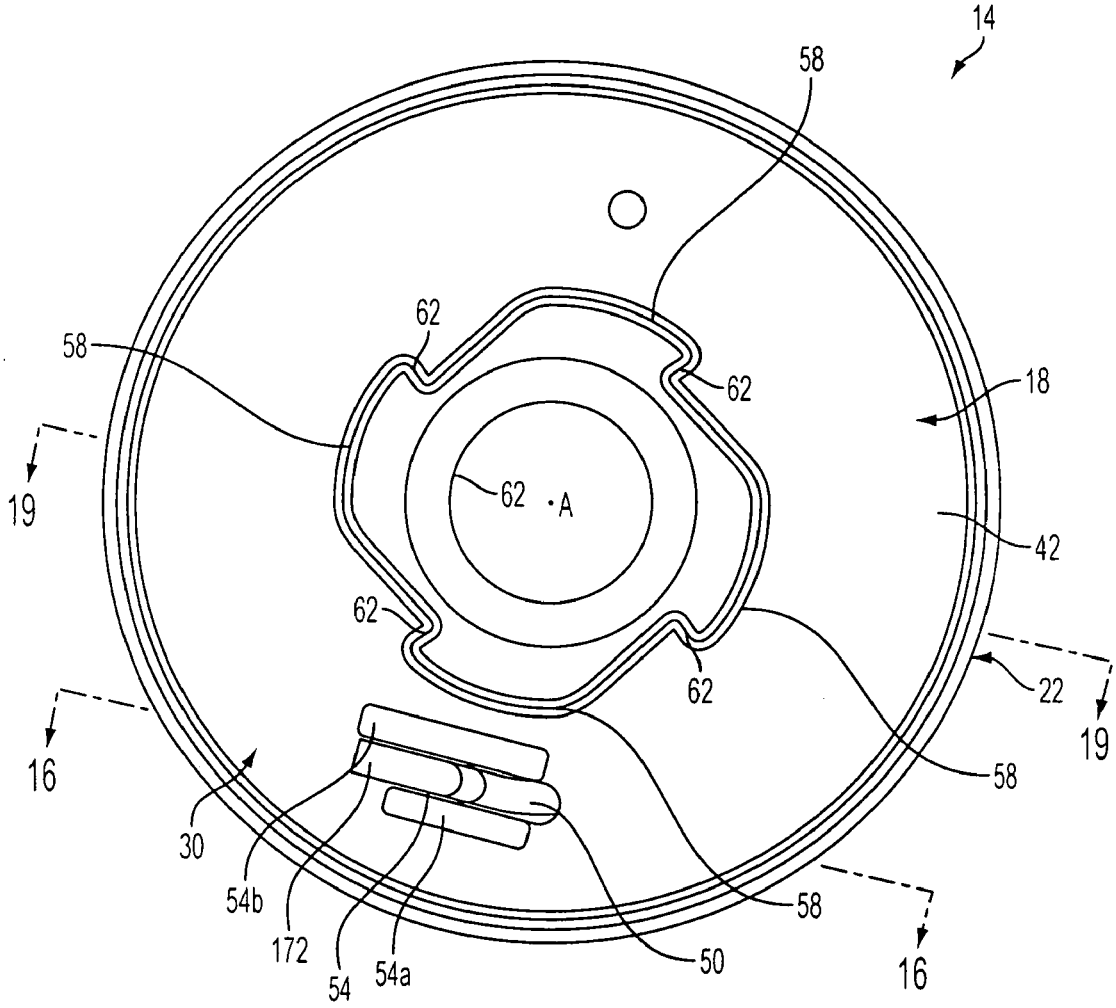
FIG. 3 is a top view of the recoil starter system shown in FIG. 1.
Figure 4:
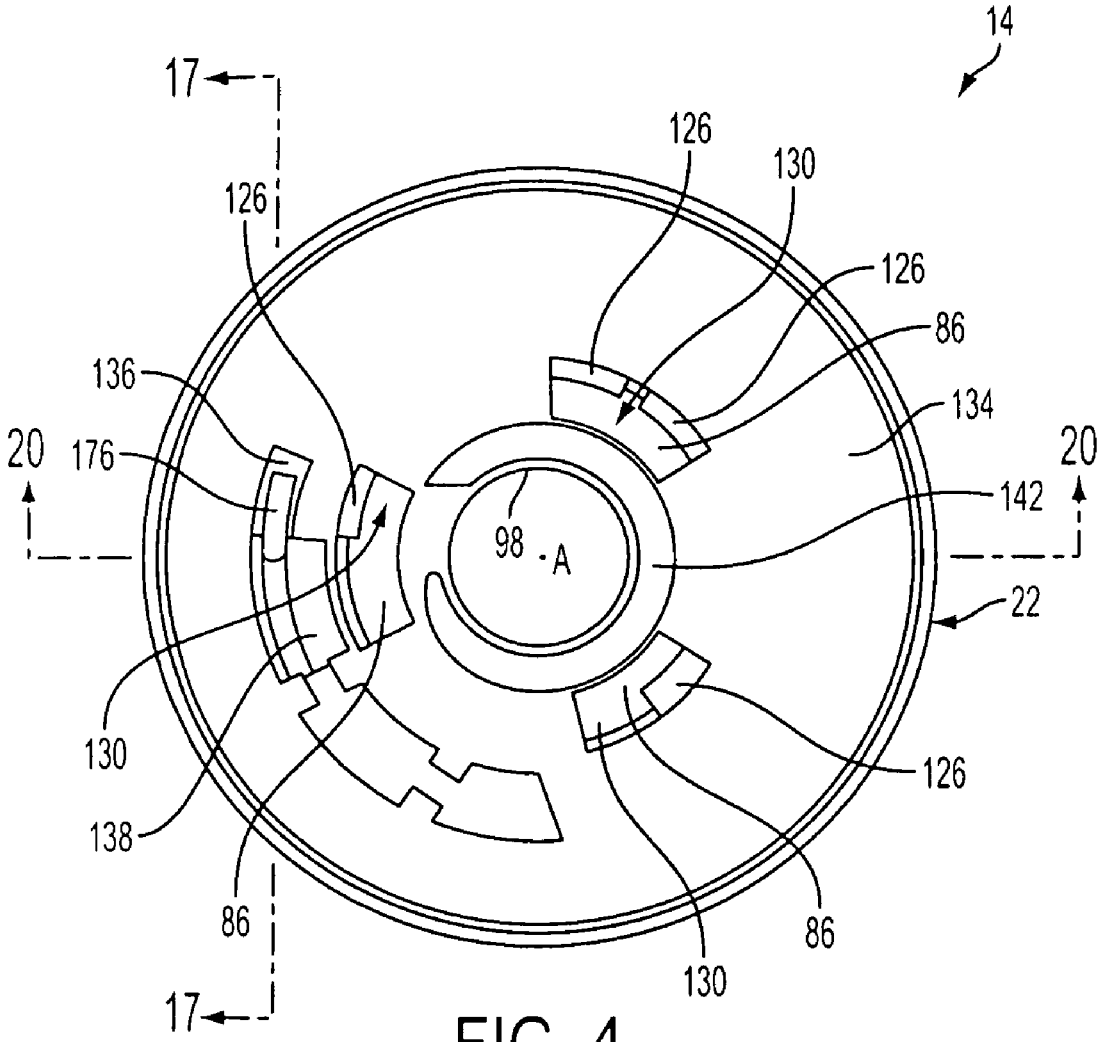
FIG. 4 is a bottom view of the recoil starter system shown in FIG. 1.
Figure 18:
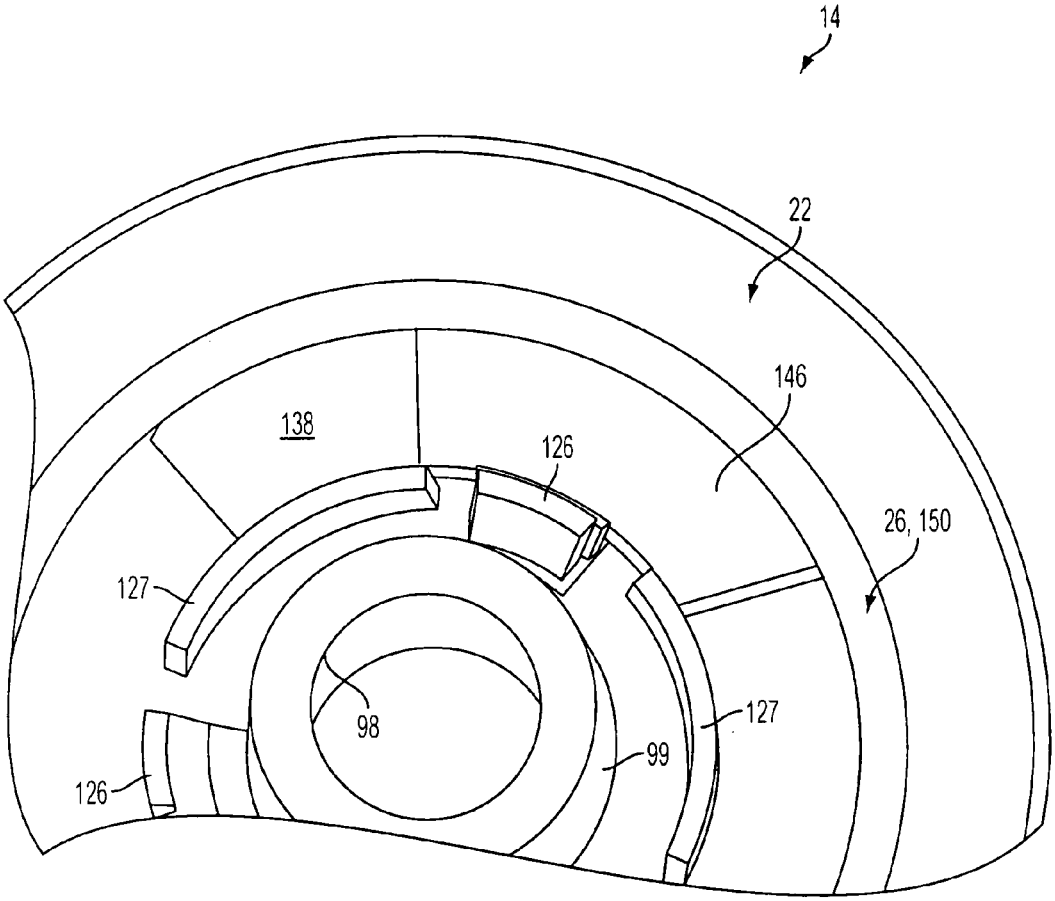
FIG. 18 is an enlarged top perspective view of the pulley member and the spring member shown in FIG. 1.
Figure 19:
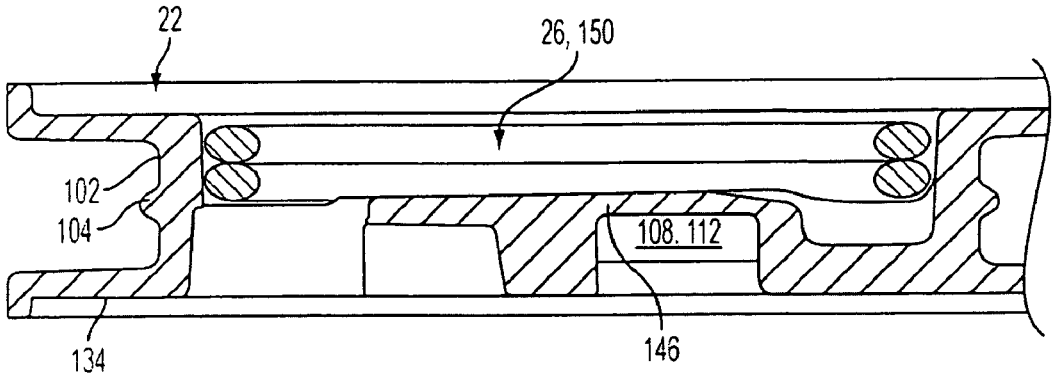
FIG. 19 is a cross-sectional view taken generally of the recoil starter system along line 19-19 in FIG. 3 with the drive member removed for clarity.
Figure 20:
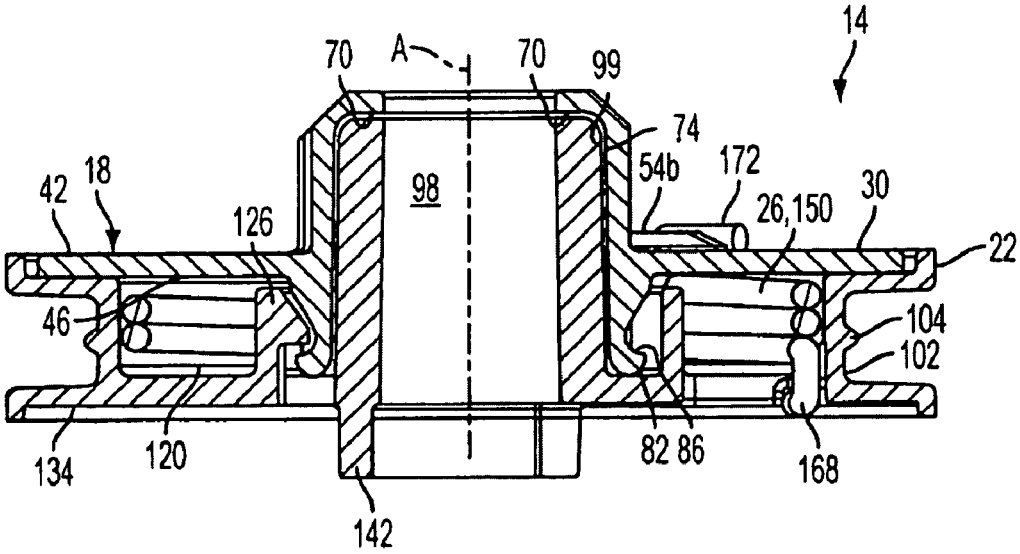
FIG. 20 is a cross-sectional view taken generally along line 20-20 in FIG. 4.

The body portion 150 is positioned in the cavity 120, and, as shown in FIGS. 18-19, the spring support 146 engages the body portion 150 to prevent tilting of the spring member 26. As shown in FIGS. 1 and 3, the first leg 164 extends through the recess 50, and the first engaging portion 172 engages the slot 54 on the drive member 18. As shown in FIGS. 2 and 4, the second leg 168 extends through the recess 138, and the second engaging portion 176 engages the slot 136 on the pulley member 22.

In the illustrated construction, engagement of the engaging portions 172, 176 with the outer surfaces 42, 134 of the drive member 18 and the pulley member 22 also inhibits relative axial movement of the members 18 and 22. Accordingly, the spring member 26 may provide at least a portion of the connecting arrangement for the recoil starter system 14.

In the illustrated construction, the spring member 26 transmits torque input from the pulley member 22 to the drive member 18. Engagement of the axially extending legs 164, 168 with the walls of the recesses 50, 138 to pivotally bias the drive member 18 and the pulley member 22. The spring member 26 may be constructed to allow relative pivoting movement greater than 90 degrees between the drive member 18 and the pulley member 22.

In other constructions, the spring member 26 may be provided by more than one spring member engaged between the members 18, 22. The spring member 26 may be a different type of spring, such as a torsion spring. Also, the spring member 26 may be provided by a different type of spring member, such as an elastomeric member.

The recoil starter system 14 is assembled as a unit. The spring member 26 is connected to the drive member by inserting the first engaging portion 172 through the recess 50 and engaging the slot 54. The drive member 18 and the pulley member 22 are aligned and axially engaged. The first retainer 80 engages the second retainer 124, causing the tabs 126 to flex as the first retainer 80 passes and then return to fully engage the first retainer 80 thereby axially connecting the drive member 18 and the pulley member 22. As the members 18, 22 are engaged, the second engaging portion 176 of the spring member 26 is inserted through the recess 138. The drive pulley 22 is then pivoted relative to the spring member 26 and the drive member 18 so that the engaging portion 176 engages the slot 136.

Once assembled, the recoil starter system 14 is connected to other components (e.g., the pull cord) and to the engine. The free end of the pull cord is received in the cord retention recess 108, and the cord is wound in the radial groove 102 on the pulley member 22. The pulley member 22 is connected to the recoil spring and supported on the housing with a support received in the central opening 98. The drive member 18 is positioned for engagement with the engine.

In operation, the pulling force on the pull cord is transferred into the pulley member 22. The resulting torque is transmitted to the spring member 26 and subsequently transferred to the drive member 18. The drive member 18 then transmits the torque to the clutch mechanism to rotate the drive shaft of the engine. The spring member 26 absorbs fluctuations in pulling torque produced by the engine to allow the operator to experience a smooth and constant pulling force. The recoil spring causes the recoil starter system 14 to return to the starting position. When the engine starts, the clutch mechanism is disengaged from the recoil starter system 14.

One or more independent features or independent advantages of the invention may be set forth in the following claims:

What is claimed is:

1. A recoil starter system comprising:

a drive member engageable with an engine and including a first retainer;

a pulley member supportable for rotation about an axis, the pulley member including a second retainer engageable with the first retainer to connect the pulley member to the drive member and to inhibit relative axial movement between the pulley member and the drive member; and a spring member coupled between the drive member and the pulley member, wherein the spring member is connected to the drive member and to the pulley member and inhibits relative axial movement of the drive member and the pulley member, wherein the drive member includes an axially-facing outer first surface, wherein the pulley member has an axially-facing outer second surface, and wherein the spring member includes a first portion engaging the first surface and a second portion engaging the second surface to inhibit relative axial movement of the drive member and the pulley member.

2. The system of claim 1, wherein the drive member is supportable for pivotal movement relative to the pulley member.

3. The system of claim 2, wherein the drive member is pivotable more than 90 degrees relative to the pulley member.

4. The system of claim 1, wherein one of the first retainer and the second retainer member includes a radially-extending annular lip, the other of the first retainer and the second retainer being engageable with the annular lip.

5. The system of claim 4, wherein the other of the first retainer and the second retainer includes a plurality of retention members, each of the plurality of retention members being spaced apart about the axis and engageable with the annular lip.

6. The system of claim 4, wherein the annular lip extends substantially 360° about the axis.

7. The system of claim 1, wherein at least one of the first retainer and the second retainer is flexible to enable engagement of the first retainer and the second retainer.

8. A recoil starter system comprising:

a drive member engageable with an engine;

a pulley member supportable for rotation about an axis; and a spring member connected between the drive member and the pulley member to inhibit relative axial movement between the drive member and the pulley member, wherein the drive member includes an axially-facing outer first surface, wherein the pulley member has an axially-facing outer second surface, and wherein the spring member includes a first portion engaging the first surface and a second portion engaging the second surface to inhibit relative axial movement of the drive member and the pulley member, wherein the drive member includes an axially-facing outer first surface, wherein the pulley member has an axially-facing outer second surface, and wherein the spring member includes a first portion engaging the first surface and a second portion engaging the second surface to inhibit relative axial movement of the drive member and the pulley member.

9. The system of claim 8, wherein, when connected, the drive member and the pulley member cooperate to define a cavity, wherein at least a substantial portion of the spring member is supported in the cavity, the first portion and the second portion extending from the cavity to engage the first surface and the second surface, respectively.

10. The system of claim 9, wherein the spring member includes an axially-extending first leg connected between the substantial portion of the spring and the first portion and an axially-extending second leg connected between the substantial portion of the spring member and the second portion.

11. The system of claim 10, wherein the drive member defines a first opening into the cavity, the first leg extending from the cavity through the first opening, and wherein the pulley member defines a second opening into the cavity, the second leg extending from the cavity and through the second opening.

12. The system of claim 11, wherein the first surface of the drive member defines a first slot communicating with the first opening, the first portion of the spring member being received in the first slot, and wherein the second surface of the pulley member defines a second slot communicating with the second opening, the second portion of the spring member being received in the second slot.

13. The system of claim 8, wherein a first end of the spring member has a first U-shape, the first portion providing a leg of the first U-shape, and wherein a second end of the spring member has a second U-shape, the second portion providing a leg of the second U-shape.

14. The system of claim 8, wherein the drive member includes a first retainer, and wherein the pulley member includes a second retainer engageable with the first retainer to connect the pulley member to the drive member and to inhibit relative axial movement between the pulley member and the drive member.

15. The system of claim 8, wherein the pulley member further includes a spring support ramp, the spring support ramp being engageable with the spring member for at least a portion of a circumference of the spring member to inhibit unwanted tilting motion of the spring member relative to the axis.

* * * * *